US008681468B2

(12) United States Patent
Jacob et al.

(10) Patent No.: US 8,681,468 B2
(45) Date of Patent: Mar. 25, 2014

(54) METHOD OF CONTROLLING SOLENOID VALVE

(75) Inventors: Steven D. Jacob, Oro Valley, AZ (US); Fares Najjar, Arlington, TX (US); Gerald W. Meyer, Tucson, AZ (US); Richard D. Ross, Sahuarita, AZ (US)

(73) Assignee: Raytheon Company, Waltham, MA (US)

( * ) Notice: Subject to any disclaimer, the term of this patent is extended or adjusted under 35 U.S.C. 154(b) by 227 days.

(21) Appl. No.: 12/696,097

(22) Filed: Jan. 29, 2010

(65) Prior Publication Data

US 2011/0094589 A1 Apr. 28, 2011

Related U.S. Application Data

(60) Provisional application No. 61/255,642, filed on Oct. 28, 2009.

(51) Int. Cl.
*H01H 9/00* (2006.01)

(52) U.S. Cl.
USPC ..... 361/154

(58) Field of Classification Search
USPC ..... 361/152, 154, 160, 189
See application file for complete search history.

(56) References Cited

U.S. PATENT DOCUMENTS

| | | | | |
|---|---|---|---|---|
| 4,266,261 | A | 5/1981 | Streit et al. | |
| 4,327,693 | A * | 5/1982 | Busser | 123/490 |
| 4,453,652 | A * | 6/1984 | Merkel et al. | 222/504 |
| 4,522,371 | A | 6/1985 | Fox et al. | |
| 4,766,921 | A | 8/1988 | Williams | |
| 4,905,120 | A * | 2/1990 | Grembowicz et al. | 361/154 |
| 5,150,879 | A | 9/1992 | Mullally | |
| 5,650,909 | A | 7/1997 | Remele et al. | |
| 6,019,441 | A | 2/2000 | Lloyd et al. | |
| 6,061,224 | A * | 5/2000 | Allen | 361/154 |
| 6,390,082 | B1 * | 5/2002 | Duffy et al. | 123/682 |
| 6,772,737 | B2 | 8/2004 | Gaessler et al. | |
| 7,023,682 | B2 * | 4/2006 | Dovheim | 361/160 |
| 7,903,383 | B2 * | 3/2011 | Fukano et al. | 361/152 |
| 2003/0179534 | A1 | 9/2003 | Hermann et al. | |
| 2009/0213520 | A1 | 8/2009 | Bedingfield et al. | |

FOREIGN PATENT DOCUMENTS

| | | | |
|---|---|---|---|
| DE | 102004056653 | A1 | 6/2006 |
| DE | 102006059624 | A1 | 6/2008 |
| EP | 0563760 | A2 | 10/1993 |
| EP | 1571679 | A2 | 9/2005 |

* cited by examiner

*Primary Examiner* — Rexford Barnie
*Assistant Examiner* — Terrence Willoughby
(74) *Attorney, Agent, or Firm* — Renner, Otto, Boisselle & Sklar, LLP

(57) ABSTRACT

A method of solenoid valve control includes measuring voltage across the solenoid valve and current through the solenoid valve, and using the results to aid in controlling the solenoid valve. For instance, one or both of the measured values may be used to determine when actual engagement of the solenoid valve occurs. An initial lower voltage and lower current can be used, and then as conditions change, the changes in condition can be accounted for by increasing voltage and current to maintain the desired response time of the solenoid valve. By measuring and controlling voltage and current less of a margin can be used, both in setting voltage/current levels and in selecting the time over which a pull voltage/current is utilized. This reduces the wasted energy in the system, as well as reducing the temperature rise in the solenoid valve.

13 Claims, 3 Drawing Sheets

METHOD OF CONTROLLING SOLENOID VALVE

This application claims priority under 35 USC 119 to U.S. Provisional Application No. 61/255,642, filed Oct. 28, 2009, which is incorporated herein by reference in its entirety.

GOVERNMENT RIGHTS

This invention was made with United States Government support under Contract Number HQ0147-09-D-0001. The United States Government has certain rights in this invention.

BACKGROUND OF THE INVENTION

1. Field of the Invention

The invention is in the field of methods and devices for controlling solenoid valves.

2. Description of the Related Art

Prior methods of controlling solenoid valves have included voltage control and current control methods. Prior voltage control methods have pulled a solenoid valve with a voltage that is much greater than a lower hold voltage used to hold the solenoid valve engaged. The timing of the switch from the higher pull voltage to the lower hold voltage is based on adding a significant margin to ensure that pull takes place. In determining the margin the possibility of variations in solenoid inductance, the possibility of variations in solenoid resistance, and possible changes in voltage of batteries or other voltage supplies are all factored in to increase the margin of time that the pull voltage is applied. The result is one or more of wasted energy, overheated solenoids, varying switching times of solenoid valves, and/or the possibility of failure to engage (a situation where engagement of the solenoid valve is not achieved).

Prior current control methods involve measuring current through the solenoid, and adjusting this current to try to achieve a higher pull-in current and a lower hold current. This can reduce somewhat the added margin applied in voltage control. Changes in resistance and inductance will change the solenoid valve response times, but the current through the solenoid remains consistent. However a margin is added to the level of the pull-in current, and the pull-in time (the time that the pull-in current is applied) also generally has a margin added to it to account for variations in manufacturing of the solenoid valve and varying conditions. The result is still energy wastage, heating in the solenoid valve, and/or the possibility of non-engagement.

It will be appreciated that it would be desirable to come up with improved methods for solenoid control.

SUMMARY OF THE INVENTION

According to an aspect of the invention, a method of controlling a solenoid valve includes measuring voltage across the solenoid valve, and current through the solenoid valve.

According to another aspect of the invention, a method of controlling a solenoid valve includes using voltage across a solenoid valve and current through the solenoid valve to control at least one of voltage or current supplied to the solenoid valve.

According to yet another aspect of the invention, a method of controlling a solenoid valve includes determining when engagement of the solenoid valve occurs.

According to still another aspect of the invention, a method of controlling a solenoid valve includes actively controlling voltage and/or current prevents overpowering of a solenoid valve.

According to a further aspect of the invention, a method of controlling a solenoid valve includes maintaining substantially the same engagement time as conditions change.

According to a still further aspect of the invention, a method of controlling a solenoid valve includes controlling engagement time.

According to another aspect of the invention, a method of controlling a solenoid valve includes techniques such as the ability to monitor battery voltage or other power supply voltage, calculation or determination of solenoid engagement time, and control of current and/or voltage based on desired response time.

According to yet another aspect of the invention, a method of controlling a solenoid valve is shown in the figures and described herein.

According to still another aspect of the invention, a solenoid valve controller is shown in the figures and described herein.

According to a further aspect of the invention, a method of controlling a solenoid valve includes the steps of: initiating engagement of the solenoid valve by applying to the solenoid valve either a pull-in voltage or a pull-in current; during the applying, monitoring at least one of average voltage across the solenoid valve or current through the solenoid valve; from the monitoring, determining completion of engagement of the solenoid valve; and after the determining, reducing either the pull-in voltage to a hold voltage, or the pull-in current to a hold current.

According to a still further aspect of the invention, a method of controlling a solenoid valve includes the steps of: initiating engagement of the solenoid valve by applying to the solenoid valve either a pull-in voltage or a pull-in current; during the applying, monitoring both average voltage across the solenoid valve and the current through the solenoid valve; from the monitoring, determining completion of engagement of the solenoid valve; and after the determining, reducing either the pull-in voltage to a hold voltage, or the pull-in current to a hold current. The reducing occurs a predetermined time lag after the determining completion of the engagement. The determining includes detecting a change in slope in the at least one of average voltage across the solenoid valve or current through the solenoid valve, wherein the slope is a change versus time of the at least one of average voltage across the solenoid valve or current through the solenoid valve. The applying includes applying a pulse width modulation voltage to achieve either the pull-in voltage or the pull-in current. The monitoring includes monitoring the current through the solenoid valve by measuring and monitoring a voltage drop across a sensor resistor placed in series with the solenoid valve. The applying, the monitoring, the determining, and the reducing are accomplished in a control circuit that is operatively coupled to the solenoid valve.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

The annexed drawings, which are not necessarily to scale, show various aspects of the invention.

DETAILED DESCRIPTION

A method of solenoid valve control includes measuring voltage across the solenoid valve and current through the solenoid valve, and using the results to aid in controlling the solenoid valve. For instance, one or both of the measured values may be used to determine when actual engagement of the solenoid valve occurs. An initial lower voltage and lower current can be used, and then as conditions change (variations in one or more of temperature, voltage (e.g., supply voltage), resistance of the solenoid valve, and inductance of the solenoid valve, to give a few examples), the changes in condition can be accounted for by increasing voltage and current to maintain the desired response time of the solenoid valve. By measuring and controlling voltage and current less of a margin can be used, both in setting voltage/current levels and in selecting the time over which a pull voltage/current is utilized. This reduces the wasted energy in the system, as well as reducing the temperature rise in the solenoid valve.

By monitoring the measured current and voltage, the point at which the solenoid valve fully engages can be determined. The point at which the current starts to temporarily decrease can be identified as the point in time at which the solenoid valve is fully engaged. After the current temporarily decreases the current will then increase. More broadly, this engagement can be determined by change in slope, such as a region of relative shallow slope (such as for current vs. time or voltage vs. time) bracketed by regions of higher slope magnitudes (steeper slopes). At a certain point after engagement the current (or voltage) can be reduced to a hold value, to maintain the engagement of the solenoid valve.

If a slower engagement time is desired, voltage, current, and time to engagement can be used to determine inputs that will result in a slower engagement. Adjusting the switching of the duty cycle of the voltage can be used to slow down engagement.

It will be appreciated that an input voltage may not be constant over time, for instance due to discharge of a battery that supplies the voltage. This effect can be detected and compensated for. The measurement of voltage across the solenoid valve detects and quantifies the effect of decay of input voltage. Compensation may be accomplished by switching the duty cycle to regulate the engagement time.

Disengagement of the solenoid valve can also be detected. When the solenoid valve is disengaged the current rises and then falls again. This indicates that the solenoid valve has reached the end of its travel, fully open or closed (depending on the type of valve).

Figure 1:
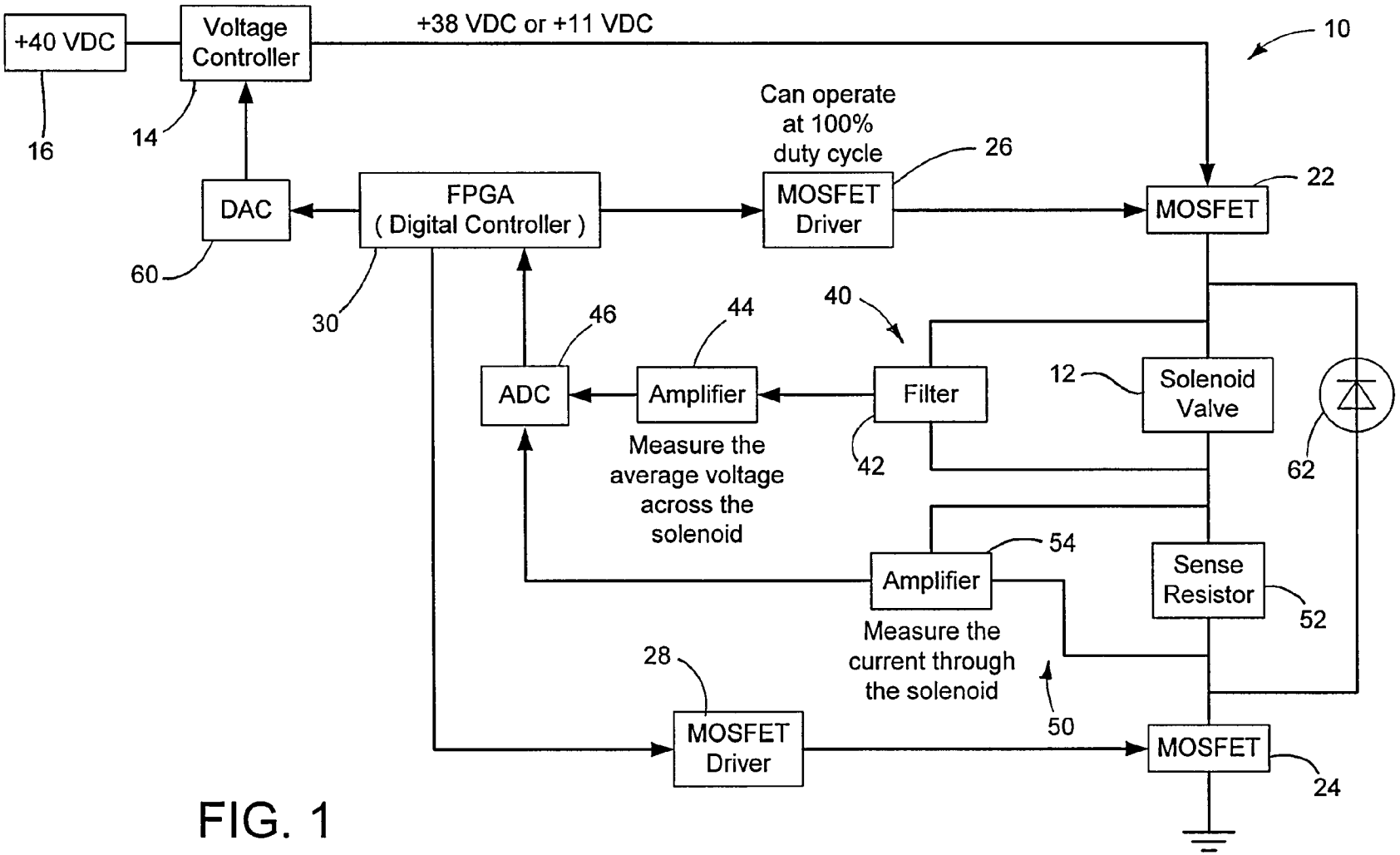
FIG. 1 is a schematic view of a control circuit for controlling a solenoid valve, in accordance with an embodiment of the invention.

FIG. 1 shows a control circuit or controller 10 for controlling operation of a solenoid valve 12. A voltage controller 14 receives voltage from a voltage supply 16, such as a battery. The voltage controller 14 may be any of a variety of suitable devices, for example a linear regulator or a switching power supply. The voltage controller 14 receives voltage from the voltage supply 16, and may output voltage at the same voltage, or at one or two different voltage levels. For example, the voltage supply 16 may send a 40 volt DC voltage to the voltage controller 14, and the voltage controller 14 may output voltage at a higher voltage level, such as 38 volts DC, and at a lower voltage level, such as 11 volts DC. Both of these output voltage levels may be below the level of the input voltage. It will be appreciated that these voltage levels are only examples, as are the voltage and current values given in the figures.

A pair of MOSFETs 22 and 24, driven by respective MOSFET drivers 26 and 28, control supply of power to the solenoid valve 12. The MOSFET drivers 26 and 28 are coupled to a field-programmable gate array (FPGA) or digital controller 30, which functions as the "brains" of the control circuit 10, controlling operation of the control circuit 10. As described further below, the FPGA 30 may receive inputs and provide a variety of different controls to the circuit 10, in order to control providing power to the solenoid valve 12.

A voltage measurement system 40 measures voltage across the solenoid valve 12. Voltage leads upstream and downstream of the solenoid valve 12 (on opposite sides of the solenoid valve 12) pass through a filter 42, and are amplified by an amplifier 44. The resulting voltage, an average voltage across the solenoid valve 12, is forwarded to an analog-to-digital (ADC) converter 46.

A current measurement system 50 is used to measure the current passing through the solenoid valve 12. The current is not measured directly. Rather a small sensor resistor 52 is placed downstream of the solenoid valve 12, between the solenoid valve 12 and the MOSFET 24. The resistor 52 may have a small resistance, for example on the order of 0.05 ohms. Voltage leads upstream and downstream of the resistor 52 are coupled to an amplifier 54, which in turn outputs a result to the ADC converter 46. Measuring the voltage drop across resistor 52 allows easy calculation of the current running through the resistor 52, using the well-known relationship of Ohm's law, $V=iR$, where V is the voltage drop across the resistor 52, i is the current, and R is the resistance of the resistor 52. Since the resistor 52 is coupled in series with the solenoid valve 12, the current passing through the resistor 52 is the same as the current through solenoid valve 12.

The ADC converter 46 forwards the measured voltage and the measured current to the FPGA 30. The FGPA 30 utilizes the information to control the MOSFET drivers 26 and 28, and the voltage controller 14. It will be appreciated that the FPGA 30 may utilize additional input information, for example the voltage at a battery or other power supply. Output signals from the FPGA 30 are sent to the voltage controller 14 through a digital-to-analog (DAC) converter 60.

A diode 62 is also coupled to the solenoid valve 12. The diode 62 may be used to bleed a residual voltage off of the solenoid valve 12 after either of the MOSFETS 22 and 24 has been switched off, interrupting flow of current to the solenoid valve 12. It will be appreciated that the diode 62 may be one of multiple diodes that are used to bleed off residual voltage from the solenoid valve 12.

It will be appreciated that many variations are possible on the configuration shown in FIG. 1. For instance various combinations of resistors, inductors, capacitors, and/or amplifiers may be used in place of one or more of the components of the controller 10. To give one example, an FPGA evaluation board with appropriated components may be used in place of the FPGA 30.

Figure 2:
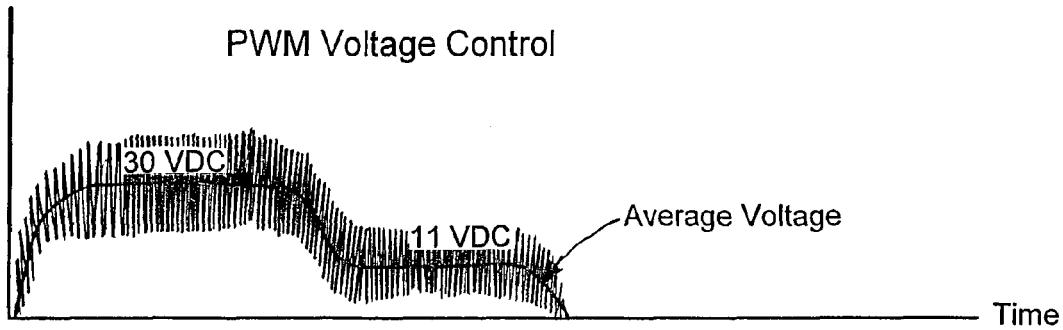
FIG. 2 is a plot illustrating a first mode of operating the control circuit of FIG. 1.

FIG. 2-5 are plots illustrating some of the possible ways of controlling operation of the solenoid valve 12 (FIG. 1) with the control circuit 10 (FIG. 1). FIG. 2 shows a plot of pulse width modulation (PWM) of the voltage applied to the solenoid 12. The modulation of the voltage input to the solenoid valve 12 may be accomplished by the FPGA 30 (FIG. 1), either through action on the voltage controller 14, or through control of the MOSFET 22. The solid line in the FIG. 2 represents an averaged voltage, with the pulse width modulation actually producing a rapid variation in voltage, above and below the averaged voltage value, as indicated by the indistinct oscillating line overlaid on the average value. The PWM may be performed achieve a high pulling voltage, 30 volts in the illustrated embodiment, to a lower hold voltage, 11 volts in the illustrated embodiment. The pulling voltage is used to move an armature of the solenoid valve, while the lower hold voltage is used to hold the armature in place after it reaches a stop at the end of its travel, when the solenoid valve is fully engaged.

Figure 3:
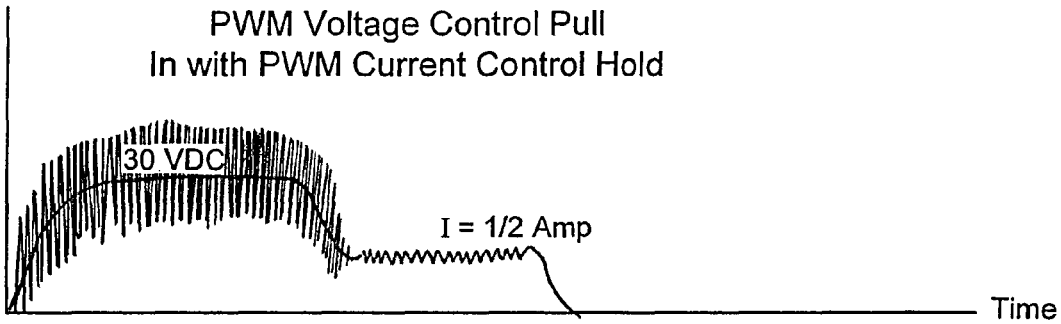
FIG. 3 is a plot illustrating a second mode of operating the control circuit of FIG. 1.

FIG. 3 shows another possible control regime, with a PWM voltage set for pulling of the solenoid, the average voltage being 30 volts in the illustrated plot, and a PWM current set to hold the solenoid valve 12 (FIG. 1) after engagement has been achieved, for example using a current of 0.5 amps. The measured current and/or the measured voltage may be used as part of a feedback loop to confirm that the desired average pulling voltage and holding current are achieved. The FPGA 30 (FIG. 1) may be configured to adjust the voltage supplied to the solenoid valve 12, in order to meet the targets for pulling voltage and/or holding current. It will be appreciated that similar feedback may be used for the other sorts of control described herein.

Figure 4:
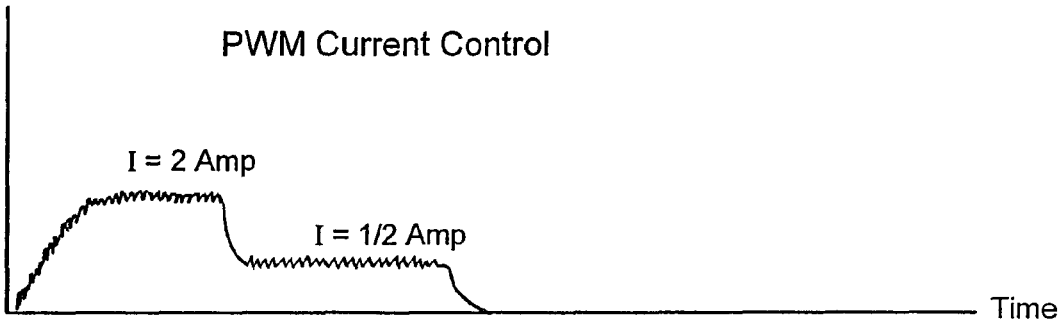
FIG. 4 is a plot illustrating a third mode of operating the control circuit of FIG. 1.

FIG. 4 shows a further possibility, using the FPGA 30 (FIG. 1) to control current through the solenoid valve 12 (FIG. 1) using PWM. The FPGA 30 may act on the voltage controller 14 (FIG. 1) or one or both of the MOSFETS 22 and 24 (FIG. 1), to accomplish control of the current through the solenoid valve 12 (FIG. 1), using PWM. The current may initially set at a high pulling current level (2 amps in the plot), and then reduced to a lower hold current (0.5 amps in the plot). As with the other embodiments, feedback may be used by the FPGA 30 to set the currents at their desired levels.

Figure 5:
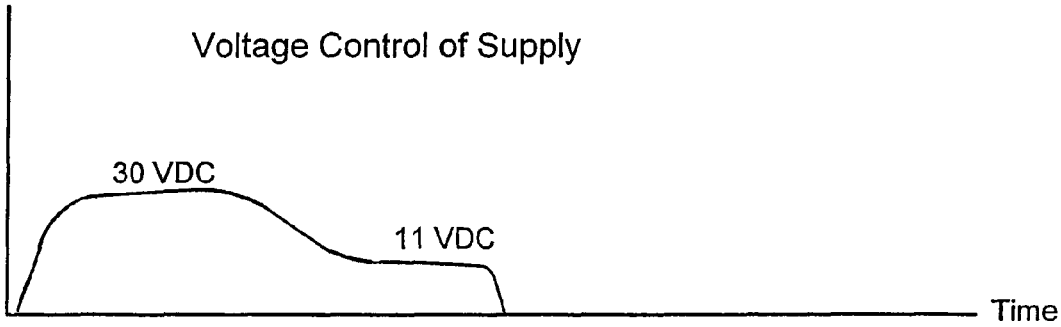
FIG. 5 is a plot illustrating a fourth mode of operating the control circuit of FIG. 1.

FIG. 5 shows a further possibility, with the FPGA 30 (FIG. 1) acting on the voltage controller 14 (FIG. 1) to directly control the voltage output from the voltage controller 14. As stated above, the voltage controller 14 may be configured to output different levels of DC voltages. In the illustrated plot, the output voltage is initially at a high pulling value of 30 volts, and then is reduced to a lower hold value of 11 volts.

Figures 6, 7, 8:
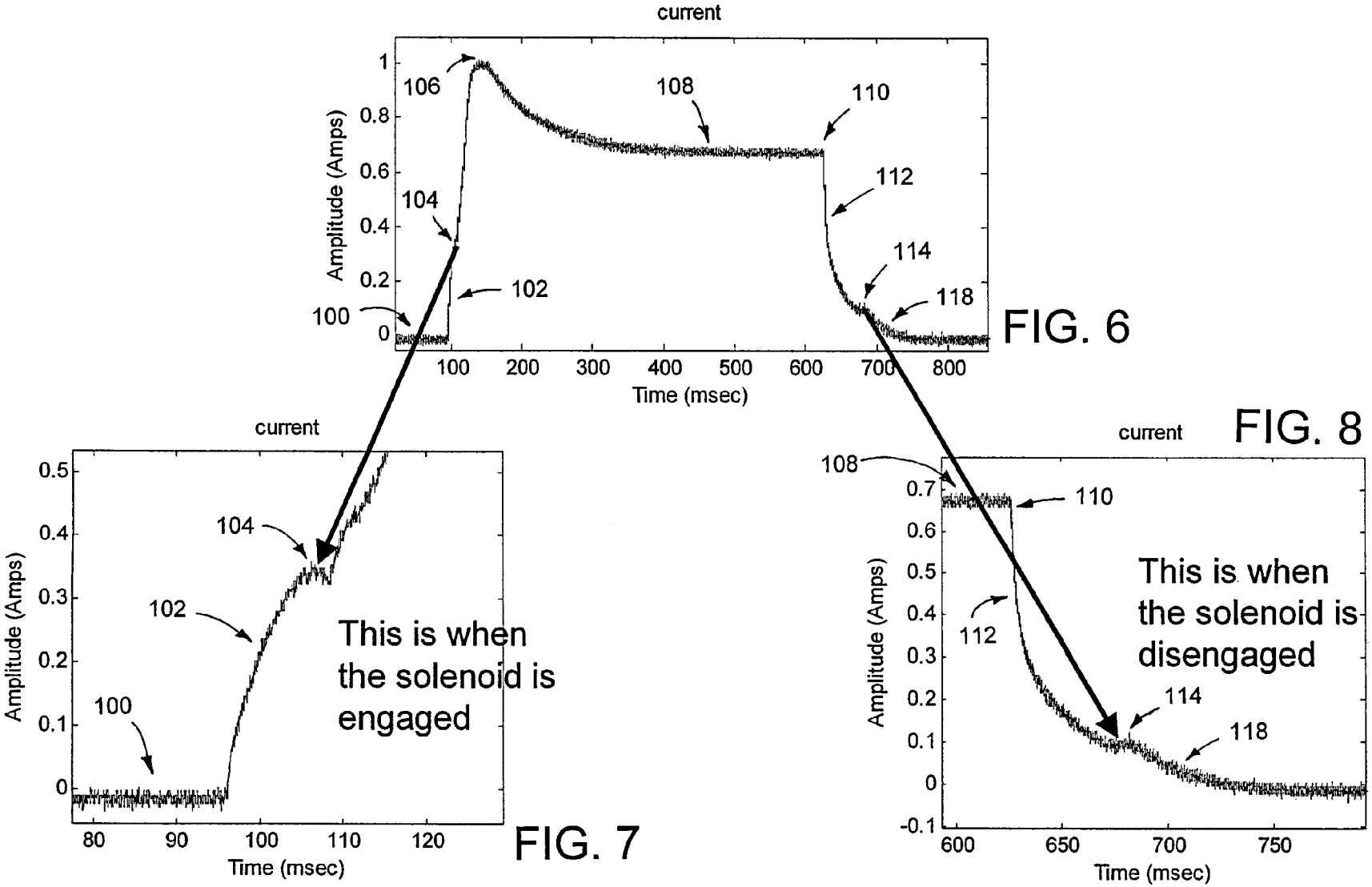
FIG. 6 is a plot of current versus time, illustrating a fifth mode of operating the control circuit of FIG. 1.
FIG. 7 is a magnified view of a portion of FIG. 6.
FIG. 8 is a magnified view of another portion of FIG. 6.

FIGS. 6-8 show a plot of current versus time during engagement, hold, and disengagement of a solenoid valve. FIG. 6 shows the entire process, while FIGS. 7 and 8 are detailed views (plots) focusing on the engagement and disengagement, respectively. At the beginning of the process, at reference 100, the current through the solenoid valve is substantially zero. Pulling voltage and/or current is applied at reference 102, and the current through the solenoid valve sharply increases with time.

At reference 104, the current undergoes a local maximum, and dips slightly before increasing again. This is an indication that the solenoid becomes fully engaged (fully opened or closed) at this point. The determination of this full engagement of the solenoid can be utilized by the FPGA 30 (FIG. 1) as a trigger for eventually shifting from a pull voltage/current to a hold voltage/current. The shift from pulling voltage/current to holding voltage/current need not be immediate. Rather a built-in time lag may be used to assure that the engagement of the solenoid holds, prior to backing off to the holding voltage/current. Nonetheless, by determining the engagement time, and utilizing that knowledge to control when to shift from a higher voltage/current to a lower voltage/current, overpowering of the solenoid may be reduced, relative to cruder prior methods.

At reference 106 the shift to holding voltage/current is made. This lower current is reached at reference 108.

The hold current is removed at reference 110. This causes a rapid reduction in the current through the solenoid valve, shown at reference 112, with the result that the solenoid valve moves (begins to disengage).

At reference 114 the slope of the current plot temporarily decreases in magnitude, perhaps even reaching zero or changing sign. This is the point where the solenoid valve becomes fully disengaged. After the disengagement the downward slope again increases in magnitude, as shown at reference 118.

It will be appreciated that the engagement and disengagement points may be identified by their changes in slope, with local reductions in slope magnitude bracketed on either side by higher-magnitude slopes. The identification of the engagement and disengagement points is discussed above in the context of a current vs. time plot, but it will be appreciated that the engagement and disengagement points alternatively may be identified by examining other suitable parameters, for example by looking at corresponding changes in the voltage across the solenoid valve.

The above-described method and controller may be used in controlling any of a wide variety of types of solenoid valves, used for any of a wide variety of applications. One possible application is control of solenoid thruster valves that control thrust from a rocket or missile.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A method of controlling a solenoid valve comprises:

initiating engagement of the solenoid valve by applying to the solenoid valve either a pull-in voltage or a pull-in current;

during the applying, maintaining either the pull-in voltage or the pull-in current and monitoring at least one of average voltage across the solenoid valve or current through the solenoid valve;

from the monitoring, determining completion of engagement of the solenoid valve; and after the determining, maintaining the pull-in voltage or the pull-in current during a predetermined time lag after the determining completion of the engagement, and then reducing either the pull-in voltage maintained during the applying to a hold voltage, or the pull-in current maintained during the applying to a hold current, wherein the reducing maintains the engagement of the solenoid valve;

wherein the monitoring includes monitoring both the average voltage across the solenoid valve and the current through the solenoid valve.

2. The method of claim 1, further comprising using the monitoring to adjust either the pull-in voltage or the pull-in current.

3. The method of claim 2, wherein the using includes adjusting either the pull-in voltage or the pull-in current for future engagement cycles.

4. The method of claim 2, wherein the using includes adjusting to compensate for discharge of a battery that supplies power for the pull-in voltage or the pull-in current.

5. The method of claim 3, wherein the adjusting is accomplished to approach a target response time for the future engagement cycles.

6. The method of claim 5, wherein the applying includes applying a pulse width modulation voltage to achieve either the pull-in voltage or the pull-in current; and wherein the adjusting includes adjusting a duty cycle of the pulse width modulation.

7. The method of claim 1, wherein the applying, the monitoring, the determining, and the reducing are accomplished in a control circuit that is operatively coupled to the solenoid valve.

8. The method of claim 7, wherein the control circuit includes a digital controller in which the determining is carried out.

9. The method of claim 1, wherein the initiating engagement includes initiating movement of an armature of the solenoid valve; and wherein the determining completion includes determining when the armature impacts a stop.

10. The method of claim 1, wherein the applying includes applying a pulse width modulation voltage to achieve either the pull-in voltage or the pull-in current.

11. A method of controlling a solenoid valve comprises:

initiating engagement of the solenoid valve by applying to the solenoid valve either a pull-in voltage or a pull-in current;

during the applying, maintaining either the pull-in voltage or the pull-in current and monitoring at least one of average voltage across the solenoid valve or current through the solenoid valve;

from the monitoring, determining completion of engagement of the solenoid valve; and after the determining, maintaining the pull-in voltage or the pull-in current during a predetermined time lag after the determining completion of the engagement, and then reducing either the pull-in voltage maintained during the applying to a hold voltage, or the pull-in current maintained during the applying to a hold current, wherein the reducing maintains the engagement of the solenoid valve;

wherein the applying, the monitoring, the determining, and the reducing are accomplished in a control circuit that is operatively coupled to the solenoid valve;

wherein the control circuit includes a digital controller in which the determining is carried out;

wherein the monitoring includes monitoring the average voltage across the solenoid valve; and wherein the average voltage is input to the digital controller after passing through a filter, an amplifier, and an analog-to-digital converter, all of which are parts of the control circuit.

12. A method of controlling a solenoid valve comprises:

initiating engagement of the solenoid valve by applying to the solenoid valve either a pull-in voltage or a pull-in current;

during the applying, maintaining either the pull-in voltage or the pull-in current and monitoring at least one of average voltage across the solenoid valve or current through the solenoid valve;

from the monitoring, determining completion of engagement of the solenoid valve; and after the determining, maintaining the pull-in voltage or the pull-in current during a predetermined time lag after the determining completion of the engagement, and then reducing either the pull-in voltage maintained during the applying to a hold voltage, or the pull-in current maintained during the applying to a hold current, wherein the reducing maintains the engagement of the solenoid valve;

wherein the applying, the monitoring, the determining, and the reducing are accomplished in a control circuit that is operatively coupled to the solenoid valve;

wherein the control circuit includes a digital controller in which the determining is carried out;

wherein the monitoring includes monitoring the current through the solenoid valve; and wherein the current is input to the digital controller after passing through an amplifier, and an analog-to-digital converter, all of which are parts of the control circuit.

13. A method of controlling a solenoid valve comprises:

initiating engagement of the solenoid valve by applying to the solenoid valve either a pull-in voltage or a pull-in current;

during the applying, maintaining either the pull-in voltage or the pull-in current and monitoring both average voltage across the solenoid valve and the current through the solenoid valve;

from the monitoring, determining completion of engagement of the solenoid valve; and after the determining, reducing either the pull-in voltage maintained during the applying to a hold voltage, or the pull-in current maintained during the applying to a hold current, wherein the reducing maintains the engagement of the solenoid valve;

wherein the reducing occurs a predetermined time lag after the determining completion of the engagement, with the pull-in voltage or the pull-in current maintained during the time lag;

wherein the determining includes detecting a change in slope in the at least one of average voltage across the solenoid or current through the solenoid, wherein the slope is a change versus time of the at least one of average voltage across the solenoid valve or current through the solenoid valve;

wherein the applying includes applying a pulse width modulation voltage to achieve either the pull-in voltage or the pull-in current;

wherein the monitoring includes monitoring the current through the solenoid by measuring and monitoring a voltage drop across a sensor resistor placed in series with the solenoid valve; and wherein the applying, the monitoring, the determining, and the reducing are accomplished in a control circuit that is operatively coupled to the solenoid valve.

* * * * *